US011520273B2

(12) United States Patent
Koyama et al.

(10) Patent No.: US 11,520,273 B2
(45) Date of Patent: Dec. 6, 2022

(54) DRIVING FORCE TRANSMITTING MECHANISM AND IMAGE FORMING APPARATUS

(71) Applicant: CANON KABUSHIKI KAISHA, Tokyo (JP)

(72) Inventors: Fuyuko Koyama, Kanagawa (JP); Yuichiro Inaba, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/404,001

(22) Filed: Aug. 17, 2021

(65) Prior Publication Data

US 2022/0066379 A1 Mar. 3, 2022

(30) Foreign Application Priority Data

Aug. 25, 2020 (JP) ..... JP2020-142023

(51) Int. Cl.
*G03G 15/00* (2006.01)
*G03G 21/16* (2006.01)

(52) U.S. Cl.
CPC ..... *G03G 15/757* (2013.01); *G03G 21/1647* (2013.01); *G03G 2221/1657* (2013.01)

(58) Field of Classification Search
CPC ..... G03G 15/757; G03G 21/1647; G03G 2221/1657
See application file for complete search history.

(56) References Cited

U.S. PATENT DOCUMENTS 9,822,822 B2 11/2017 Matsumoto
2016/0169290 A1* 6/2016 Matsumoto ..... G03G 21/1647 403/376
2018/0113412 A1* 4/2018 Koyama ..... G03G 15/757

FOREIGN PATENT DOCUMENTS

JP 2016114127 A 6/2016

* cited by examiner

*Primary Examiner* — Sandra Brase
(74) *Attorney, Agent, or Firm* — Rossi, Kimms & McDowell LLP

(57) ABSTRACT

Provided is a driving force transmitting mechanism including: a first rotating member which rotates around a first rotation axial; a driving force transmitting member which rotates together with the first rotation member, and to which driving force is transmitted from the first rotating member; a cylindrical shaft which contacts with the first rotating member in a diameter direction, and which includes an engaging portion to engage with the driving force transmitting member, and is coaxially rotated with the first rotating member by the driving force from the driving force transmitting member at the engaging portion; and a second rotating member which is rotated around a second rotation axial, disposed next to the first rotation axis in an axial direction, by the driving force transmitted from the cylindrical shaft. The first rotating member includes at least one contacting portion that contacts with the second rotating member.

12 Claims, 18 Drawing Sheets

DRIVING FORCE TRANSMITTING MECHANISM AND IMAGE FORMING APPARATUS

BACKGROUND OF THE INVENTION

Field of the Invention

The present invention relates to a driving force transmitting mechanism that transmits driving force and an image forming apparatus.

Description of the Related Art

In recent years, in an image forming apparatus such as a copier and a printer, a configuration, of using a cylindrical shaft having a hollow structure as a driving force transmitting component to transmit the driving force, is known. Japanese Patent Application Publication No. 2016-114127 discloses a configuration of a driving force transmitting mechanism of a driving roller related to image formation, where a coupling member that connects a solid shaft, which is a shaft of a driving roller, and a cylindrical shaft having a hollow structure, which transmits the driving force from a gear, is disposed. In the case of the driving force transmitting configuration according to Japanese Patent Application Publication No. 2016-114127, highly precise transmission of the rotary driving force is implemented by disposing the coupling member between the cylindrical shaft, which is a member of the driving force transmitting source, and the shaft of the driving roller, which is a member of the driving force transmitting destination.

SUMMARY OF THE INVENTION

Although it is possible to implement highly precise driving force transmission using the configuration according to Japanese Patent Application Publication No. 2016-114127, recently a driving force transmitting configuration that can implement a driving force transmitting with an even higher precision is demanded.

It is an object of the present invention to provide a driving force transmitting mechanism that can transmit driving force with even higher precision in a configuration of transmitting driving force between two rotation axes, and an image forming apparatus that includes this driving force transmitting mechanism.

To solve the above mentioned problem, a driving force transmitting mechanism of the present invention includes:

a first rotating member which includes a transmitting surface and rotates around a first rotation axis;

a driving force transmitting member which includes a transmitted surface and rotates together with the first rotation member, and to which driving force is transmitted from the first rotation member by the transmitted surface contacting with the transmitting surface;

a cylindrical shaft which contacts with the first rotating member in a direction perpendicular to the first rotation axis, and which includes an engaging portion to engage with the driving force transmitting member, and is coaxially rotated with the first rotating member by the driving force transmitted from the driving force transmitting member at the engaging portion; and a second rotating member which is rotated around a second rotation axis, disposed next to the first rotation axis in an axial direction, by the driving force transmitted from the cylindrical shaft, wherein the first rotating member includes at least one contacting portion that contacts with an outer peripheral surface of the second rotating member.

According to the present invention, a driving force transmitting mechanism that can transmit driving force at an even higher precision in a configuration of transmitting driving force between two rotation axes, and an image forming apparatus that includes this driving force transmitting mechanism, can be provided.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Embodiment 1 of the present invention will be described with reference to the drawings. In Embodiment 1, a full color electrophotographic image forming apparatus, in which four process cartridges are detachably installed, is exemplified as an electrophotographic image forming apparatus of the present invention. However, a number of process cartridges installed in the electrophotographic image forming apparatus (hereafter referred to as "image forming apparatus") is not limited to four, and may be set to any appropriate number as required. For example, in a case of an image forming apparatus that forms a monochrome image, a number of process cartridges installed in the image forming apparatus is one. Further, in Embodiment 1, a printer is exemplified as an aspect of the image forming apparatus, but the present invention is also applicable to other image forming apparatuses, such as a copier and a facsimile, or other image forming apparatuses that combine these functions, such as a multifunction unit.

Figure 1:
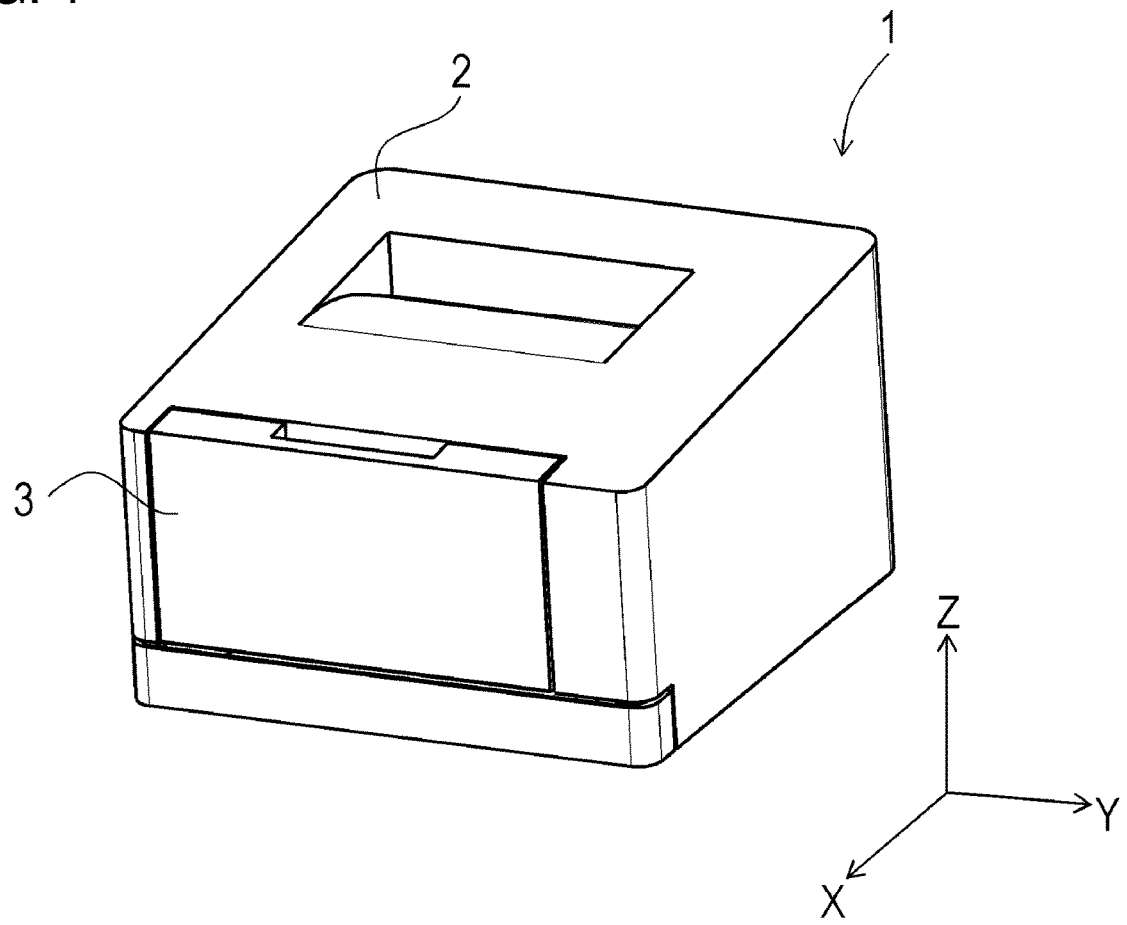
FIG. 1 is a perspective view depicting an example of an electrophotographic image forming apparatus according to an embodiment of the present invention.
Figure 2:
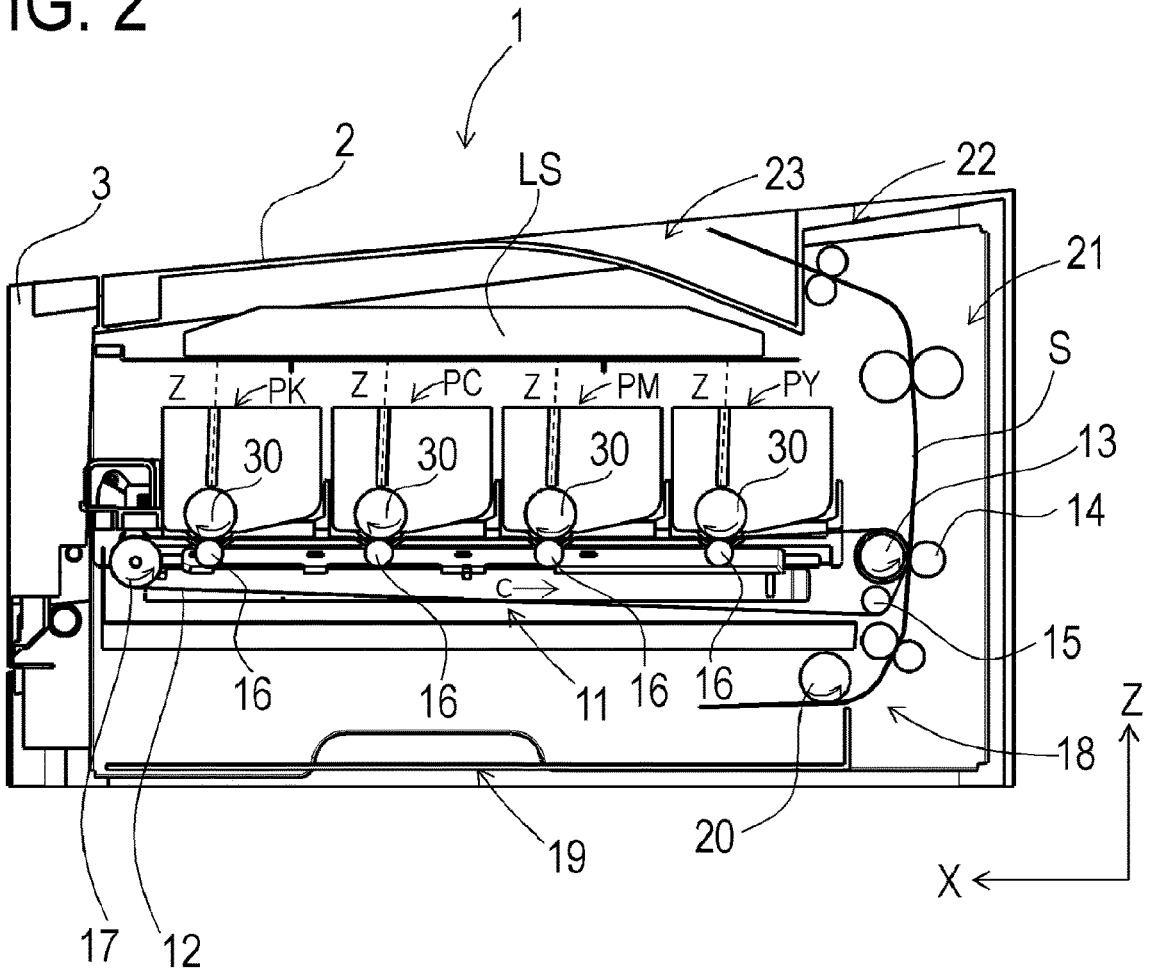
FIG. 2 is a schematic cross-sectional view depicting the example of the electrophotographic image forming apparatus according to an embodiment of the present invention.

FIG. 1 is an external perspective view, and FIG. 2 is a schematic cross-sectional view of an image forming apparatus to which the present invention is applied. This image forming apparatus 1 is a four-color full color laser printer using the electrophotographic process, and forms color images on sheet S (recording material). The image forming apparatus 1 is a process cartridge type, and forms color images on the sheet S using process cartridges P (hereafter referred to as "cartridges"), which are detachably installed in an apparatus main body 2.

In the image forming apparatus 1, it is assumed that the side where an apparatus open/close door 3 is disposed is the front face, and a surface on the opposite side of the front face is the back face (rear face). When the image forming apparatus 1 is viewed from the front face, the right side is a driving side, and the left side is a non-driving side.

In the apparatus main body 2, four cartridges P (PY•PM•PC•PK), that is, a first cartridge PY, a second cartridge PM, a third cartridge PC and a fourth cartridge PK, are disposed in the horizontal direction. Each of the first to fourth cartridges P (PY•PM•PC•PK) includes a similar electrophotographic process mechanism, and includes developer (hereafter referred to as "toner") of which each color is different from others). To the first to fourth cartridges P (PY•PM•PC•PK), a rotary driving force is transmitted from a cartridge driving force transmitting portion (not illustrated) of the apparatus main body 2. Further, to each of the first to fourth cartridges P (PY•PM•PC•PK), bias voltage (e.g. charging bias, developing bias) is supplied (not illustrated) from the apparatus main body 2.

The first cartridge PY contains yellow (Y) toner, and forms a yellow toner image on a surface of a photosensitive drum 30. The second cartridge PM contains magenta (M) toner, and forms a magenta toner image on the surface of the photosensitive drum 30. The third cartridge PC contains cyan (C) toner, and forms a cyan toner image on the surface of the photosensitive drum 30. The fourth cartridge PK contains black (K) toner, and forms a black toner image on the surface of the photosensitive drum 30.

Above the first to fourth cartridges P (PY•PM•PC•PK), a laser scanner unit LS is disposed as an exposure unit. The laser scanner unit LS outputs laser light Z in accordance with the image information. Then the laser light Z passes through an exposure window portion of the cartridge P, and scans and exposes the surface of the photosensitive drum 30.

Below the first to fourth cartridges P (PY•PM•PC•PK), an intermediate transfer belt unit 11 is disposed as a transfer member. This intermediate transfer belt unit 11 includes a driving roller 13, a tension roller 17 and an assist roller 15, where a flexible transfer belt 12 is installed. The transfer belt 12 is rotary-driven by a driving roller 13 in the arrow C direction. The rotary-driving force is transmitted to the driving roller 13 from a belt driving force transmitting portion 50 (described later) of the apparatus main body 2.

A lower surface of the photosensitive drum 30 of each of the first to fourth cartridges P (PY•PM•PC•PK) contacts an upper surface of the transfer belt 12. This contacting portion is a primary transfer portion. Primary transfer rollers 16 are disposed on the inner side of the transfer belt 12 so as to face each photosensitive drum 30. A secondary transfer roller 14 is contacted to the driving roller 13 via the transfer belt 12. The contacting portion of the transfer belt 12 and the secondary transfer roller 14 is a secondary transfer portion.

A feeding unit 18 is disposed below the intermediate transfer belt unit 11. This feeding unit 18 includes a paper feeding cassette 19 in which sheets S are stacked and housed, and a sheet feeding roller 20.

A fixing unit 21 and a discharging unit 22 are disposed on the upper left side inside the apparatus main body 2 in FIG. 2. The upper surface of the apparatus main body 2 is a paper delivery tray 23. The sheet S, on which a toner image is fixed by a fixing device disposed in the fixing unit 21, is discharged onto the paper delivery tray 23.

Figure 3:
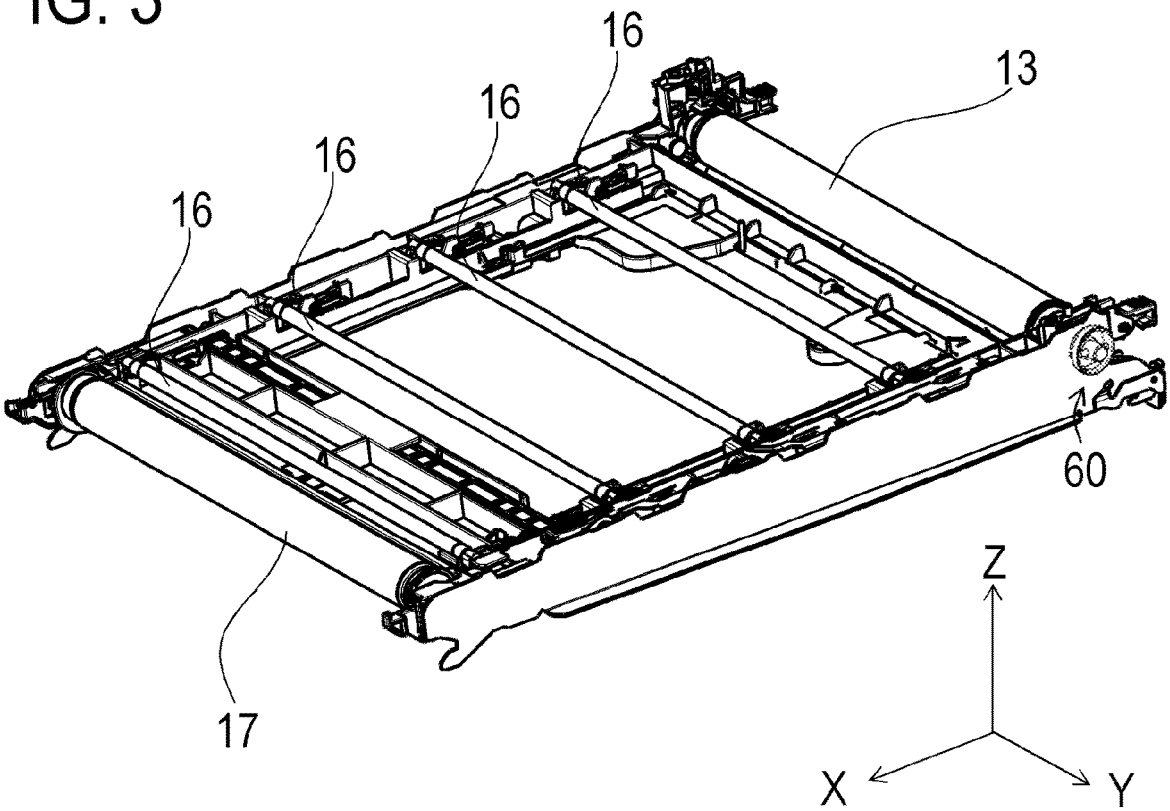
FIG. 3 is a perspective view depicting an example of an intermediate transfer belt unit according to an embodiment of the present invention.

FIG. 3 is a perspective view depicting an example of the intermediate transfer belt unit 11, which is a part of an image forming unit. In FIG. 3, illustration of the transfer belt 12 is omitted. One end of the driving roller 13 is a receiving portion 60 that receives the driving force from the belt driving force transmitting portion 50. The belt driving force transmitting portion 50 will be described in detail below.

Figure 4:
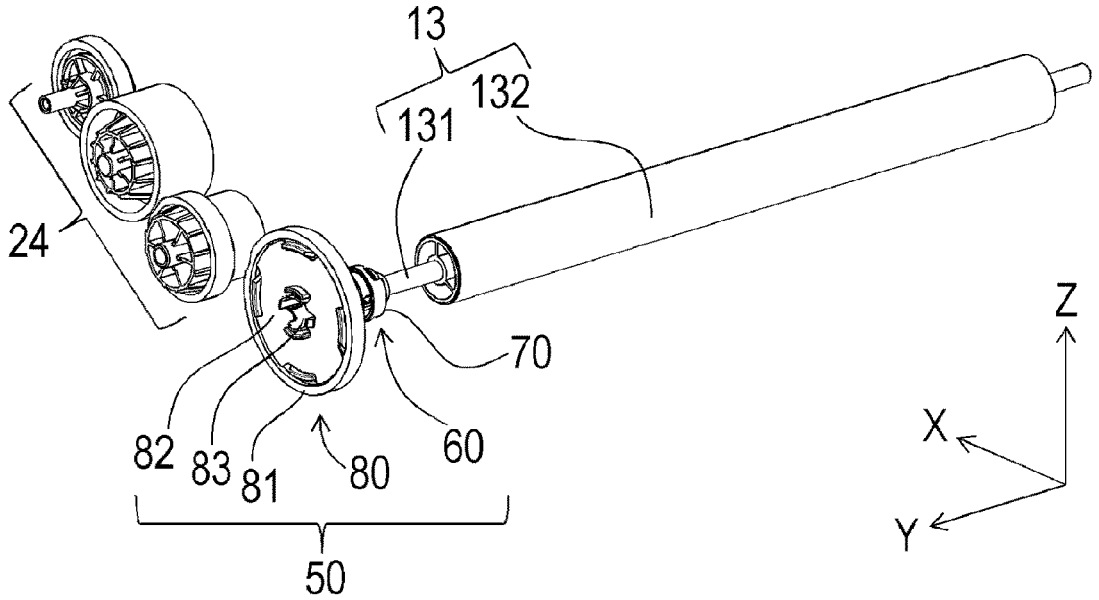
FIG. 4 is a perspective view depicting a configuration of a driving roller and a belt driving force transmitting portion.

FIG. 4 is a perspective view depicting a configuration of the driving roller 13 and the belt driving force transmitting portion 50. The belt driving force transmitting portion 50 according to Embodiment 1 is constituted of: a bearing 70 which is disposed on the driving roller 13; a driving force receiving portion 60; and a driving force transmitting unit 80 (described later) which is disposed on the driving source (not illustrated) side, and rotates by the driving force received from the driving source.

Here the driving force transmitting unit 80 is constituted of: a driving force transmitting gear 81 which is a first rotating member; a driving force transmitting plate 82 which is a driving force transmitting member (driving force transmitting metal plate); and a cylindrical shaft 83 which is a metal tubular shaft. The driving force from the driving source is transferred in the sequence of the driving force transmitting gear 81, the driving force transmitting plate 82 and the cylindrical shaft 83 (described in detail later). A driving force transmitting mechanism 24 is disposed between the driving source and the driving force transmitting gear 81. The configuration to transmit the rotary driving force from the driving force transmitting gear 81 to the driving roller 13, which is a rotating member (shaft 131 used as the second rotating member), corresponds to the driving force transmitting mechanism of the present invention.

Figure 5:
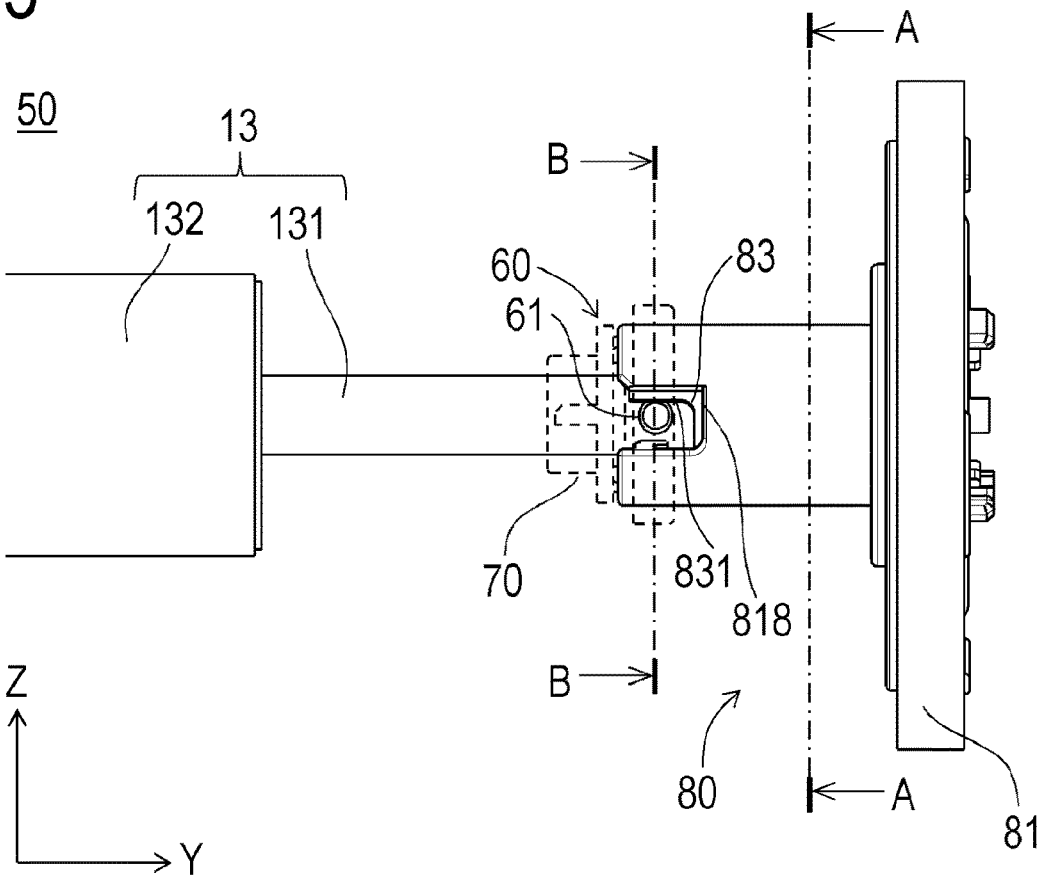
FIG. 5 is a front view depicting a configuration of a driving force transmitting unit of Embodiment 1.

As illustrated in FIG. 5, the driving roller 13 includes: a shaft 131 (an example of a shaft member) which is formed in a cylindrical shape; and a contacting portion 132 which is a cylindrical portion formed on the outer peripheral surface side of the shaft 131, and contacts with the inner peripheral surface of the transfer belt 12. One end portion side of the shaft 131 becomes the driving force receiving portion 60 which receives the driving force. In the driving force receiving portion 60, a pin 61 (connecting member) is inserted into a through hole formed in the shaft 131, and the pin 61 is engaged with the cylindrical shaft 83, whereby the driving force of the cylindrical shaft 83 is transmitted to the pin 61. In Embodiment 1, a position where the through hole is formed and where the pin 61 and the cylindrical shaft 83 are engaged in the axis direction of the shaft 131, is called a "driving force transmitting point" to transmit the driving force from the cylindrical shaft 83 to the shaft 131.

Driving Force Transmitting Unit

A configuration of the driving force transmitting unit 80 will be described next. As mentioned above, the driving force transmitting unit 80 is disposed on the driving source (not illustrated) side inside the belt driving force transmitting portion 50, and the driving force transmitting gear 81 receives the driving force from the driving force transmitting mechanism 24 and transmits the rotary driving force to the cylindrical shaft 83 via the driving force transmitting plate 82. The rotary driving force is transmitted in a state where the rotation axis of the driving force transmitting gear 81 (first rotation axis) and the rotation axis of the driving roller 13 (shaft 131) (second rotation axis) are next to each other in the axial direction. In other words, the driving force transmitting gear 81 and the driving roller 13 (shaft 131) are around an approximately same rotation axial line (approximately coaxially).

Figure 6A:
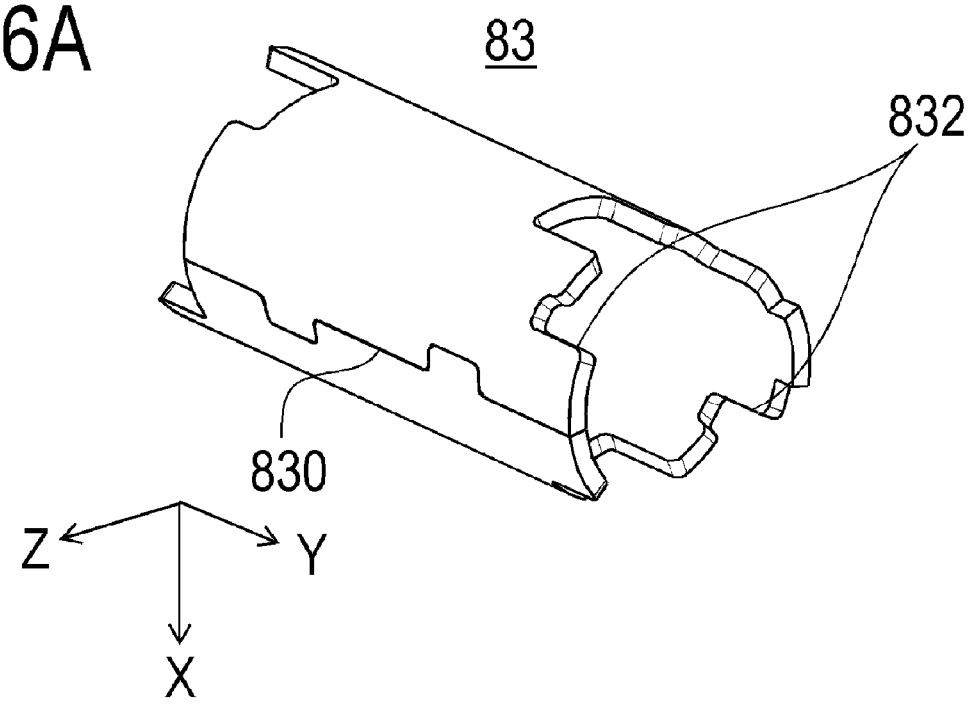
FIG. 6A and FIG. 6B are perspective views depicting a shape of a cylindrical shaft of Embodiment 1.
Figure 6B:
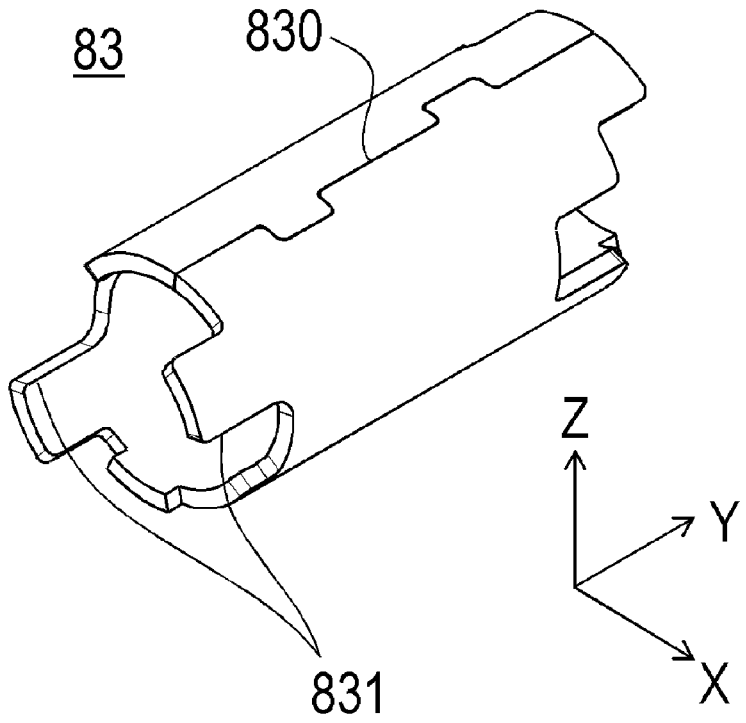

FIG. 5 is a front view depicting a configuration of the belt driving force transmitting portion 50, and FIG. 6A and FIG. 6B are perspective views depicting a cylindrical shaft according to Embodiment 1. The cylindrical shaft 83 illustrated in FIG. 6A and FIG. 6B is a press-formed body formed by bending a metal plate into an approximately cylindrical shape. The cylindrical shaft 83 formed by pressing the metal plate includes a circumferential direction end portion as a joint portion 830, where both end portions of the metal plate in the axial line direction face or abut with each other in the circumferential direction. In Embodiment 1, a concave portion recessed in the circumferential direction is formed on one end portion, and a convex portion, which protrudes in the circumferential direction, is formed on the other end portion that faces one end portion, and the concave portion and the convex portion fit with each other so as to minimize deviation of both end faces at the joint portion 830. The cylindrical shaft 83 also includes an end face 831 and an end face 832, which are end faces (side end faces or circumferential direction end faces) of the convex portion that protrudes in the shaft line direction from the approximately circular end face at the end portion of the axial line direction. The end face 831 and the end face 832 become driving force transferring portions with the pin 61 the driving force transmitting plate 82 respectively. The cylindrical shaft 83 is included in the driving force transmitting gear 81.

Figure 7:
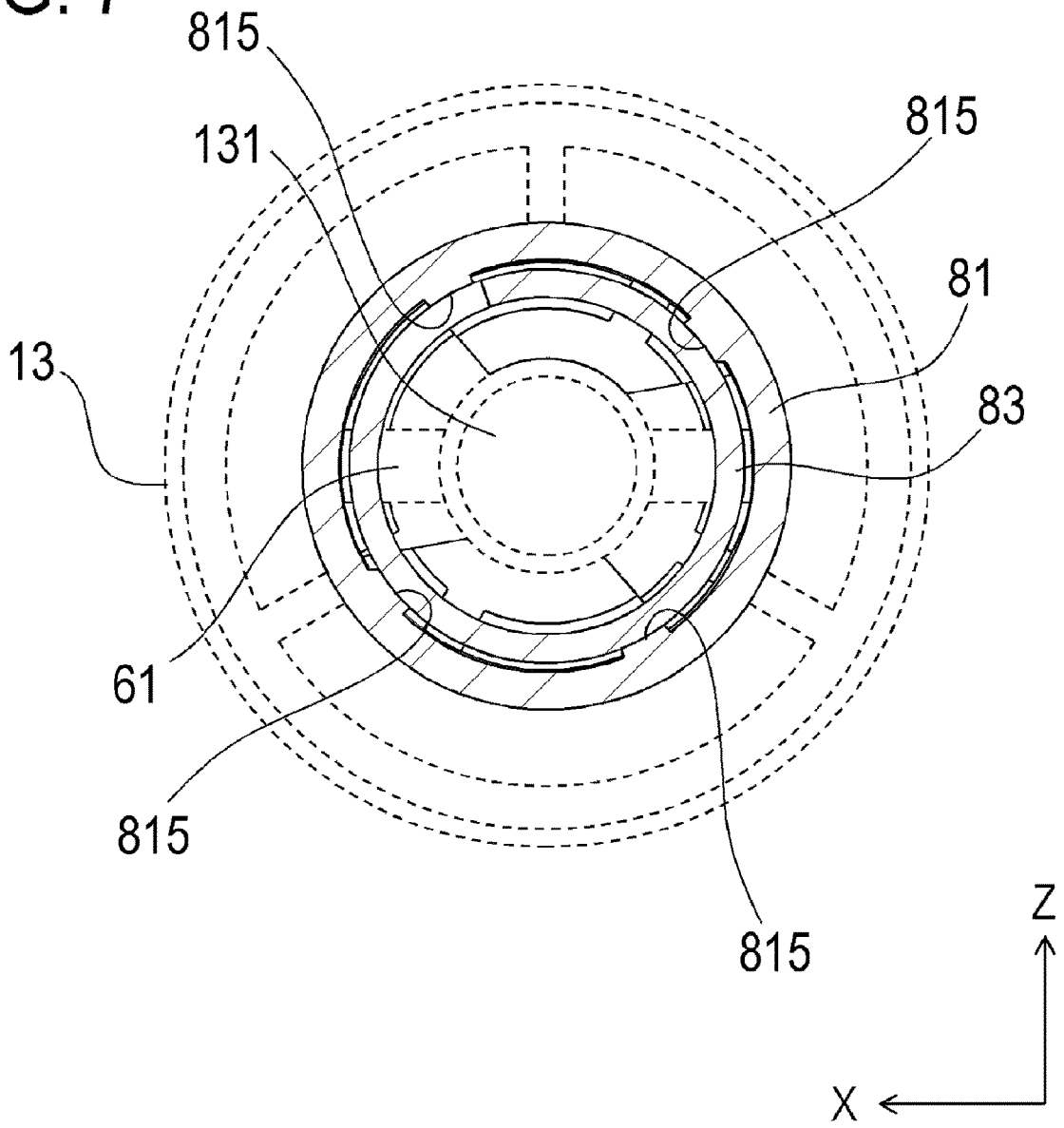
FIG. 7 is a cross-sectional view depicting a configuration of the driving force transmitting unit of Embodiment 1.

FIG. 7 is a cross-sectional view sectioned at the A-A line indicated in FIG. 5. As illustrated in FIG. 7, a contacting portion 815 that partially contacts with the outer peripheral surface of the cylindrical shaft 83 is disposed inside the driving force transmitting gear 81. Thereby the driving force transmitting gear 81 and the cylindrical shaft 83 contact with each other in a diameter direction, which is perpendicular to the rotation axis, and the center axis of the driving force transmitting gear 81 and the center axis of the cylindrical shaft 83 are aligned. The cylindrical shaft 83 of Embodiment 1 is a metal plate cylindrical shaft, hence the center axis of the driving force transmitting gear 81 and the center axis of the cylindrical shaft 83 are aligned by fitting the outer peripheral surface of the cylindrical shaft 83 and the contacting portion 815, since dimensional precision is easily controlled when the metal plate cylindrical shaft is pressed. The contacting portion 815 is disposed at a position not in contact with the joint portion 830, considering the shape of the joint portion 830 where the metal plate abut in the cylindrical shaft 83. Since the center axis of the driving force transmitting plate 82 aligns with the center axis of the cylindrical shaft 83 during rotation, driving force can be transmitted at high precision with little rotation irregularities. Further, the contacting surface (contacting portion 815) between the driving force transmitting gear 81 and the cylindrical shaft 83 is located inward in the radius direction, compared with the contacting portion (811*a*, 821*a*) between the driving force transmitting gear 81 and the driving force transmitting plate 82 in the rotating direction, which is described later.

Figure 8:
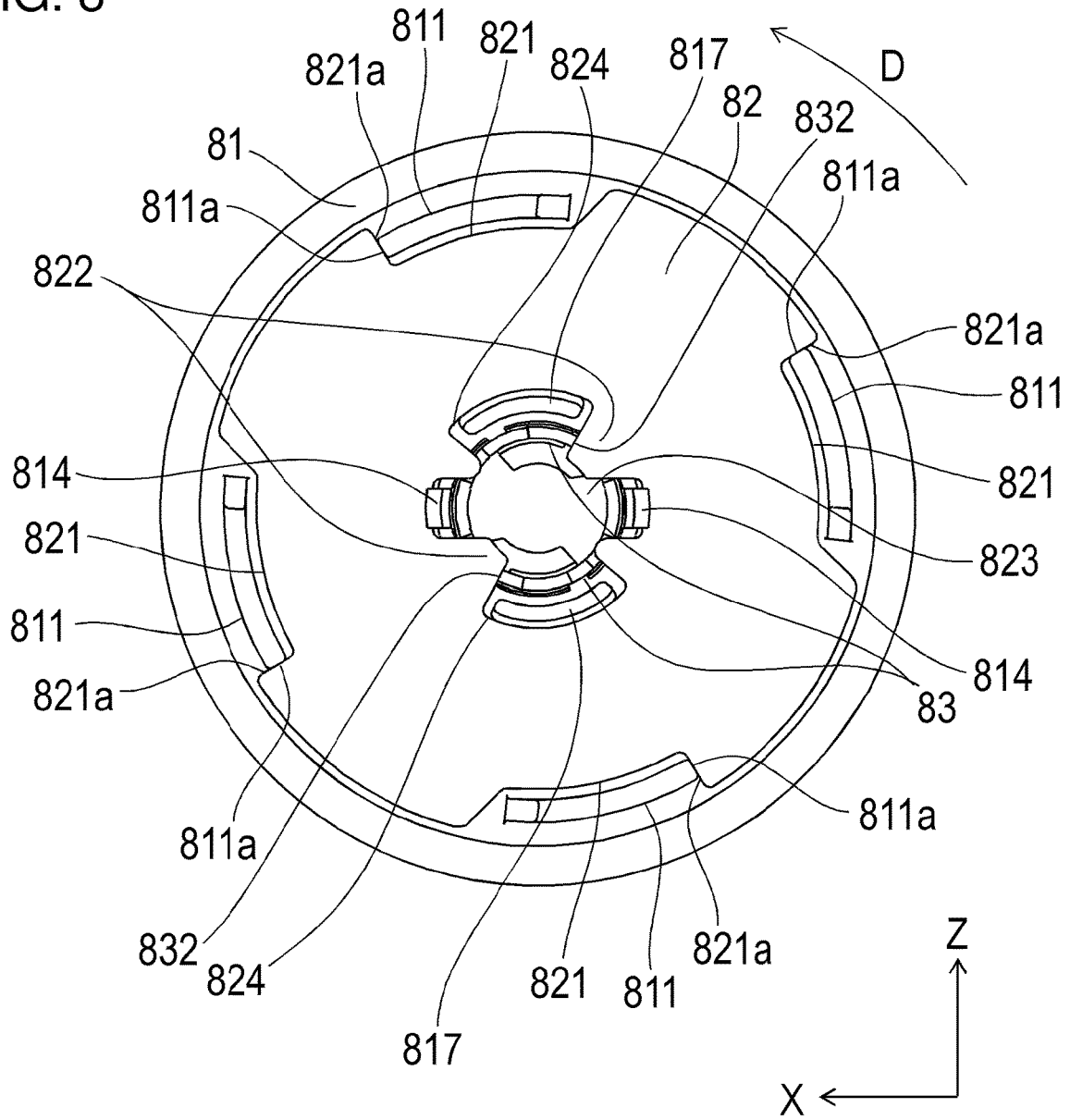
FIG. 8 is a diagram depicting the configuration of the driving force transmitting unit of Embodiment 1.

FIG. 8 is a diagram depicting the driving force transmitting unit 80 viewed from the side of the driving force transmitting plate 82. The driving force transmitting unit 80 rotates in the direction of arrow D. As illustrated in FIG. 8, on the side face of the driving force transmitting gear 81, one or a plurality of projected portions 811 are disposed on a same circumference that is distant from the center of a pitch circle of the bear by a predetermined distance, and a driving force transmitting surface 811*a* is disposed on each of the protruding portions 811 on the front side in the rotating direction D of the driving force transmitting gear 81. The driving force transmitting plate 82, on the other hand, is a plate member, and has one or a plurality of notched portions 821 on the circular maximum outer peripheral surface. In each of the notched portions 821, a driving force transmitted surface 821*a* is disposed on the front side of the rotating direction inside the notch, so as to contact with the driving force transmitting surface 811*a* of the projected portion 811, disposed on the driving force transmitting gear 81, in the circumferential direction. The contacting surfaces of the driving force transmitting surface 811*a* and the driving force transmitted surface 821*a* are located on a line connecting an arbitrary point on the circumference of the driving force transmitting gear 81 and the center of the driving force transmitting gear 81. Thereby the direction of the force applied to the contacting surface can align with the rotating direction, and the driving force transmitting loss can be controlled.

A hole 823 is formed at the center portion of the driving force transmitting plate 82, and one or a plurality of protruding portions 822 are disposed so as to protrude from the inner peripheral surface of the hole 823 in the direction toward the center (inward in the diameter direction). Each of the protruding portions 822 transmit the driving force by engaging with the end face 832 (engaging portion with the driving force transmitting plate 82) on the cylindrical shaft 83 in the circumferential direction (rotating direction), hence the tip of the protruding portion 822 is configured to enter the inner side of the radius of the outer peripheral surface radius of the cylindrical shaft 83.

Now the driving force transmission from the driving force transmitting gear 81 to the cylindrical shaft 83 will be described in detail. First the driving force transmission from the driving force transmitting gear 81 to the driving force transmitting plate 82 is performed between the driving force transmitting surface 811*a* of the driving force transmitting gear 81 and the driving force transmitted surface 821*a* of the driving force transmitting plate 82, which contact each other in the circumferential direction (rotating direction). The contacting surface between the driving force transmitting surface 811*a* and the driving force transmitted surface 821*a* is disposed to be distant from the center of the driving force transmitting gear 81 by a predetermined distance, hence the force applied to the contacting surface in accordance with the distance from the center of the gear, with respect to the torque on the shaft, can be decreased. Further, if a plurality of driving force transmitting surfaces 811*a* and driving force transmitted surfaces 821*a* are disposed, load applied to one location of the driving force transmitting surface 811*a* on the gear can be distributed in accordance with a number of disposed driving force transmitting surfaces 811*a* and driving force transmitted surfaces 821*a*. As mentioned above, the driving force transmission from the driving force transmitting plate 82 to the cylindrical shaft 83 is performed at the contacting portion between the protruding portion 822 of the driving force transmitting plate 82 and the end face 832 disposed on one end portion of the cylindrical shaft 83. The driving force transmitting gear 81 includes projected portions 817, each of which has a curved surface, of which center axis is the rotation axis of the driving force transmitting gear 81. By the projected portions 817 fitting with the fitting portions 824 disposed at the hole 823 of the driving force transmitting plate 82, the rotation axis of the driving force transmitting gear 81 and the rotation axis of the driving force transmitting plate 82 are aligned, so as to perform stable rotation.

The position of the driving force transmitting plate 82 in the rotation axis direction is regulated in one direction by abutting the side face of the driving force transmitting gear 81. In the opposite direction, according to Embodiment 1, the driving force transmitting plate 82 is pressed in the direction toward the driving force receiving portion 60 in a region outside the projected portion 817 of the driving force transmitting gear 81, by a member (not illustrated) that slidably presses the driving force transmitting plate 82. By the entire driving force transmitting unit 80 being pressed via the driving force transmitting plate 82, the cylindrical shaft 83 is engaged with the driving force receiving portion 60.

Figure 9:
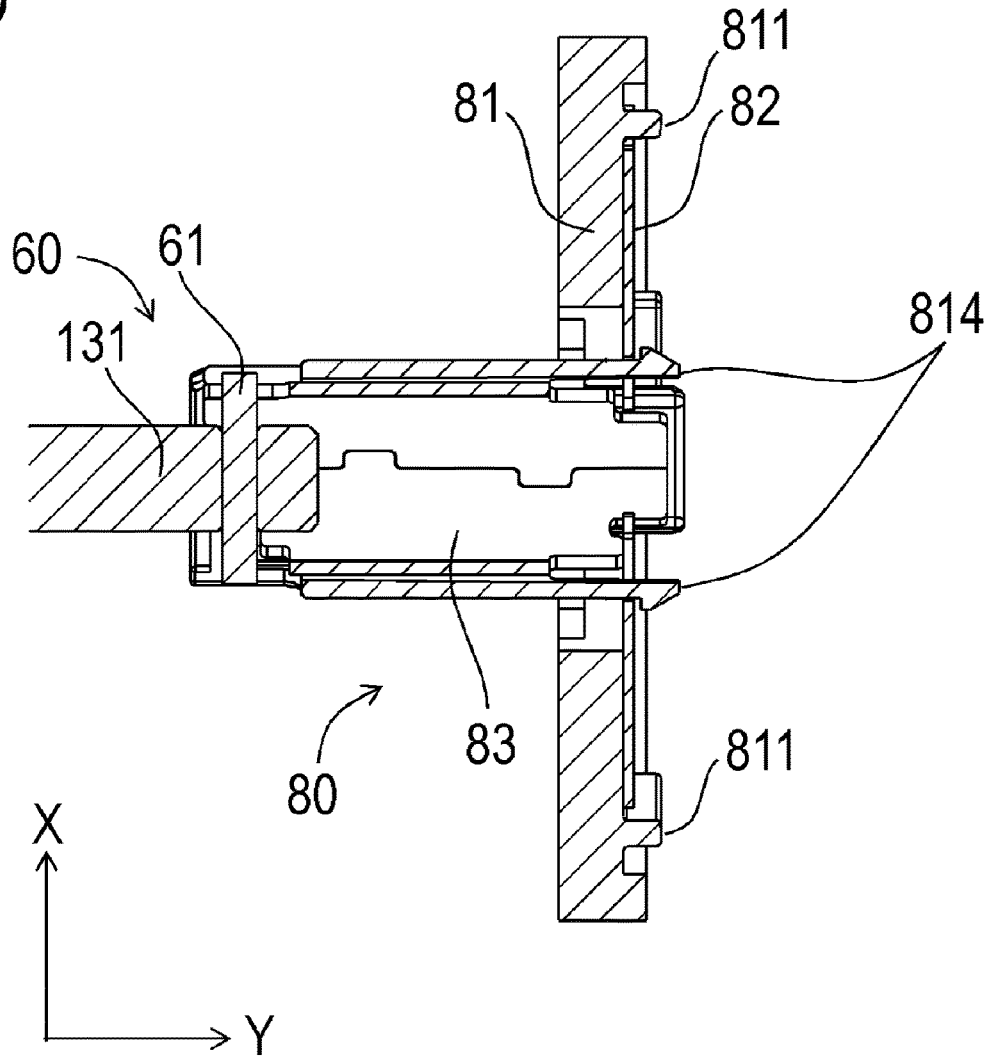
FIG. 9 is a cross-sectional view depicting the configuration of the driving force transmitting unit of Embodiment 1.

FIG. 9 is a cross-sectional view of the belt driving force transmitting portion 50 sectioned at a plane passing the axial line of the shaft 131 and the axial line of the pin 61. As illustrated in FIG. 9, the cylindrical shaft 83 is included in the driving force transmitting gear 81, and the driving force transmitting plate 82 is installed after inserting the cylindrical shaft 83 into the driving force transmitting gear 81. Claw portions 814 are disposed in the driving force transmitting gear 81, as illustrated in FIG. 8 and FIG. 9. When the driving force transmitting plate 82 is installed in the driving force transmitting gear 81, the roots of the claw portions 814 are bent inward in the radius direction, and the claw portions 814 are released from the installation track of the driving force transmitting plate 82, and when the driving force transmitting plate 82 reaches the normal installation position of the driving force transmitting gear 81, the claw portions 814 recover from the bent state. Thereby the claw portions 814 engage with the driving force transmitting plate 82. There is a gap between each claw portion 814 and the driving force transmitting plate 82. The height of each projected portion 811 is designed to be sufficiently high, so that the driving force transmitting plate 82 does not override the projected portions 811, even if the driving force transmitting plate 82 shifts close to the engaging side of the claw portions 814 in the direction of the center axis of the driving force transmitting gear 81. Thereby the cylindrical shaft 83 and the driving force transmitting plate 82 do not disengage from the driving force transmitting gear 81, and the driving force transmitting gear 81, the cylindrical shaft 83 and the driving force transmitting plate 82 become one unit (integrated) (driving force transmitting unit 80).

Here, according to Embodiment 1, the driving force transmitting plate 82 is pressed by a pressing member (not illustrated), as mentioned above, whereby the entire driving force transmitting unit 80 is pressed, and the cylindrical shaft 83 is engaged with the driving force receiving portion 60. In the case of separating the driving force transmitting unit 80 from the driving force receiving portion 60, on the other hand, the driving force transmitting unit 80 is moved away from the driving force receiving portion 60 by a predetermined distance. The cylindrical shaft 83 and the driving force transmitting plate 82, constituting the driving force transmitting unit 80, are configured to not disengage from the driving force transmitting gear 81 at this time. Thereby the mutual positions of components can be correctly maintained, even if disconnection and connection are repeated, or even if irregular vibrations are applied. Furthermore, the integrated driving force transmitting unit 80 can be handled the same way as a single gear unit, which improves operability.

At this time, the driving force transmitting gear 81, the driving force transmitting plate 82 and the cylindrical shaft 83 are installed with end play from each other in the rotating direction, so that the driving force can be transmitted at correct contacting portions from the driving force transmitting gear 81 to the driving force transmitting plate 82, and from the driving force transmitting plate 82 to the cylindrical shaft 83.

Figure 10:
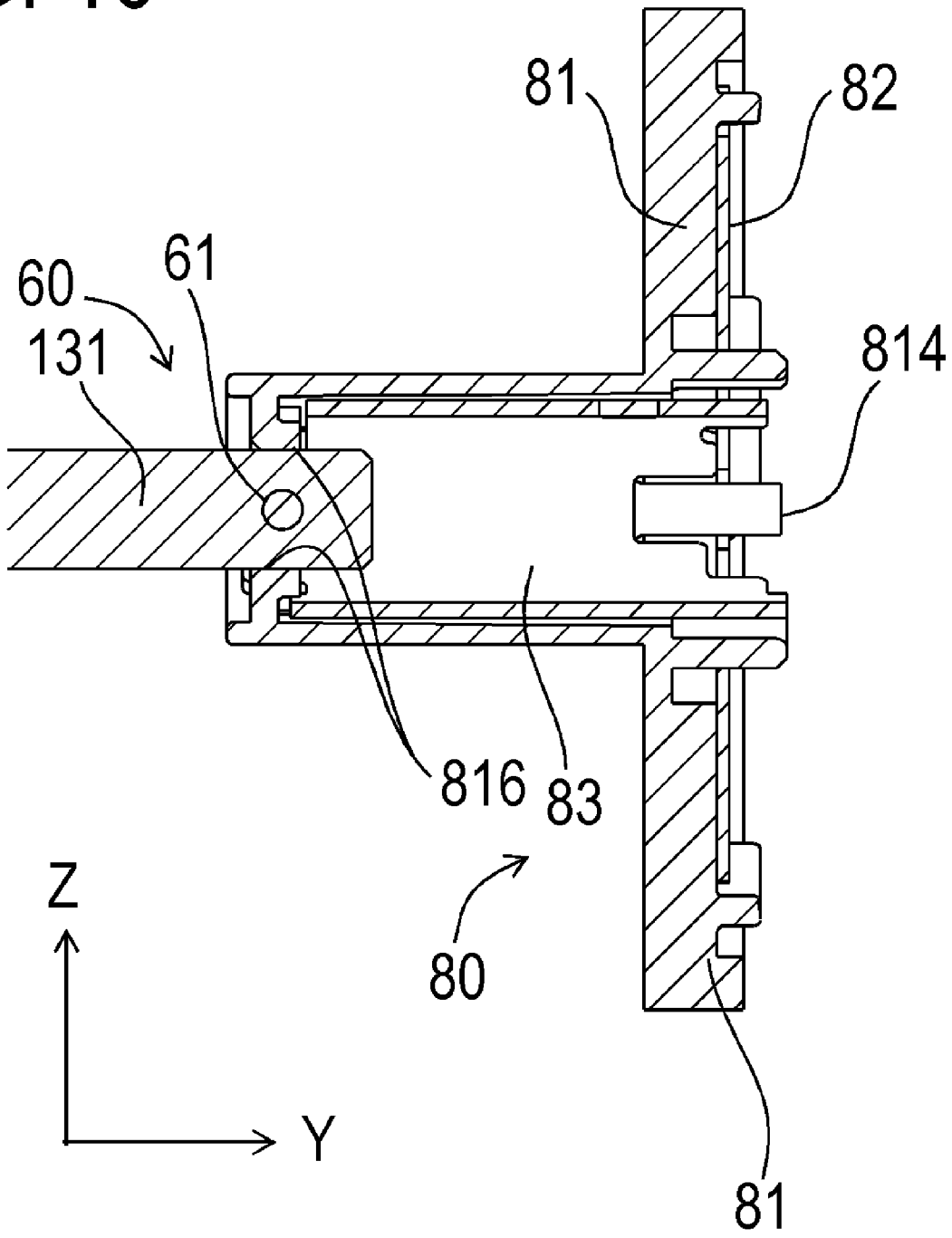
FIG. 10 is a cross-sectional view depicting the configuration of the driving force transmitting unit of Embodiment 1.

The driving force transmission between the driving force transmitting unit 80 and the driving force receiving portion 60 will be described next. FIG. 10 is a cross-sectional view sectioned at a plane passing through the axial line of the shaft 131 of the belt driving force transmitting portion 50, viewed from the front direction of the main body.

As mentioned above, in the driving force receiving portion 60 according to Embodiment 1, the pin 61 is inserted into the through hole formed in the shaft 131, and the pin 61 is engaged with the cylindrical shaft 83, whereby the driving force of the cylindrical shaft 83 is transmitted to the pin 61. The pin 61 (an example of the driving force transfer member and insertion member) is formed in a cylindrical shape, and is inserted into the through hole formed in the shaft 131 in a non-press-fitting state. The pin 61 is disposed in a state where both end portions thereof protrude from the outer peripheral surface of the shaft 131 (see FIG. 9 and FIG. 10). Further, as illustrated in FIG. 4 and FIG. 5, the shaft 131 includes the bearing 70 made of resin, in the vicinity of the driving force receiving portion 60, and the bearing 70 also plays a role of regulating the movement of the pin 61 inside the through hole in the thrust direction. In Embodiment 1, where the pin 61 is not fixed to the shaft 131, movement of the pin 61 in the thrust direction must be regulated by the bearing 70. However in the case where the pin 61 is fixed to the shaft 131 (press-fitted into the through hole, for example), the bearing 70 is not necessary as a member to regulate the movement of the pin 61.

As mentioned above, the cylindrical shaft 83 is included in the driving force transmitting gear, and as illustrated in FIG. 5, a groove 818 is formed in the cylindrical shaft driving force transmitting gear 81, and the end face 831 disposed on the cylindrical shaft 83, which is the contacting surface between the cylindrical shaft 83 and the pin 61, is exposed. The distance between the end face 831 and an end face of the concave groove 818 on the upstream side in the rotating direction is larger than the diameter of the pin 61, so that the pin 61 can be inserted between the end face 831 and the end face of the groove 818 on the upstream side in the rotating direction. The driving force is transmitted from the cylindrical shaft 83 to the pin 61 at the contacting point between the end face 831 and the pin 61, and the shaft 131 and the driving roller 13 rotate by the rotation of the pin 61 inserted into the through hole of the shaft 131.

Figure 11:
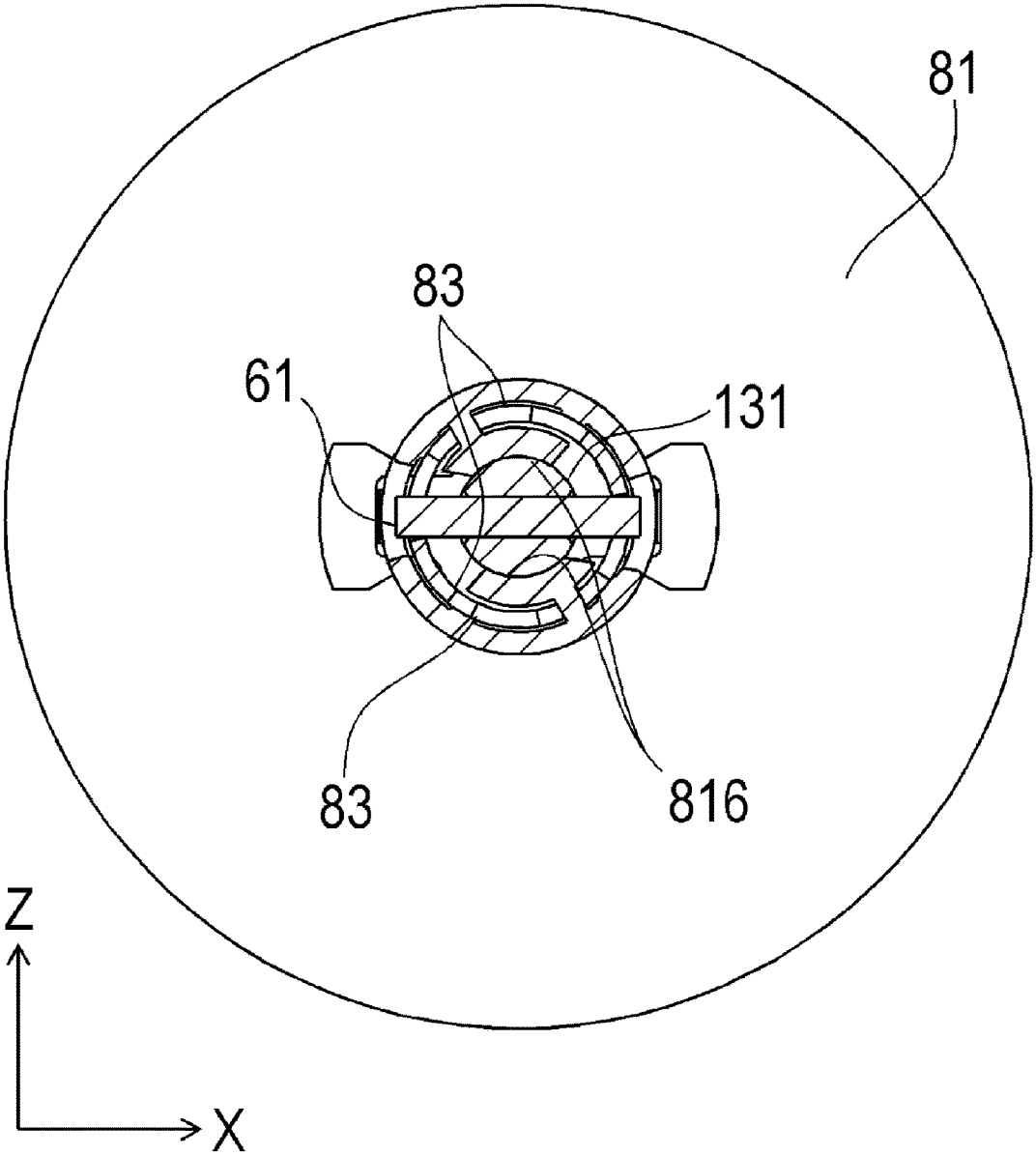
FIG. 11 is a cross-sectional view depicting the configuration of the driving force transmitting unit of Embodiment 1.

FIG. 11 is a cross-sectional view sectioned at the B-B line indicated in FIG. 5, and indicates the state where the cylindrical shaft 83 and the pin 61 are engaged. As illustrated in FIG. 10 and FIG. 11, in the driving force transmitting gear 81, a contacting portion 816, which contacts with the outer peripheral surface of the shaft 131, is disposed in the vicinity of the contacting portion between the cylindrical shaft 83 and the pin 61, in the direction of the center axis of the driving force transmitting gear 81. The contacting portion 816 is disposed in a portion of the driving force transmitting gear 81 in the circumferential direction, except for the portion of the groove 818 to which the pin 61 is inserted (see FIG. 5). In other words, in the rotation axial line direction, the position where the contacting portion 816 contacts with the outer peripheral surface of the shaft 131 and the position where the pin 61 and the cylindrical shaft 83 are engaged are approximately the same position, or at least partially overlap. The two contacting portions 816 are curved surfaces having a slightly larger curvature than the outer peripheral surface of the shaft 131, and the tip of the shaft 131 contacts with the contacting portion 816. In Embodiment 1, the two contacting portions 816 are curved surfaces having a slightly larger curvature than the outer peripheral surface of the shaft 131, but each contacting portion may be formed by a plurality of planes instead of a curved surface. In this case, it may be designed such that the diameter of the virtual circle inscribed inside the plurality of planes is slightly larger than the shaft diameter of the shaft 131, and the tip of the shaft 131 contacts with the contacting portion 816.

It is preferable that the driving force transmitting unit 80 engages with the shaft 131 in a slightly inclined state to enable transmission of the driving force even if the rotation axis of the shaft 131 and the rotation shift of the driving force transmitting unit 80 are misaligned. For this, it is preferable that the length of the contacting portion 816 in the direction of the driving force transmitting rotation axis is not unnecessarily long.

In Embodiment 1, the contacting portion 816 is disposed at the contacting portion between the cylindrical shaft 83 and the pin 61 in the direction of the center axis of the driving force transmitting gear 81, that is, in the vicinity of a point where the driving force is transmitted from the cylindrical shaft 83 to the shaft 131, or a position at least partially overlapping with the driving force transmitting point. Thereby deviation of the driving force transmitting point is controlled, and stable driving force transmission is implemented.

According to Embodiment 1, in the belt driving force transmitting portion 50, the contacting portion 816, disposed in the driving force transmitting gear 81, contacts with the outer peripheral surface of the shaft 131 to which the driving force is transmitted via the cylindrical shaft 83, as described above, whereby the rotary driving force is transmitted from the driving force transmitting gear 81 to the driving roller 13. Because of this configuration, deviation of the driving force transmitting point between the cylindrical shaft 83 and the shaft 131 is controlled, and a driving force transmission at even higher precision is implemented.

Embodiment 2

Embodiment 2 of the present invention will be described with reference to FIG. 12 to FIG. 18. Embodiment 2 is different from Embodiment 1 only in the configuration of the belt driving force transmitting portion, and rest of the configuration is the same as Embodiment 1, hence redundant description is omitted. The driving force transmitting portion according to Embodiment 2 is also constituted of the driving force transmitting unit and the driving force receiving portion, just like Embodiment 1, and the driving unit according to Embodiment 2 is referred to as a "driving force transmitting unit 280", and the driving force transmitting unit according to Embodiment 2 is referred to as a "belt driving force transmitting portion 250".

Figure 12:
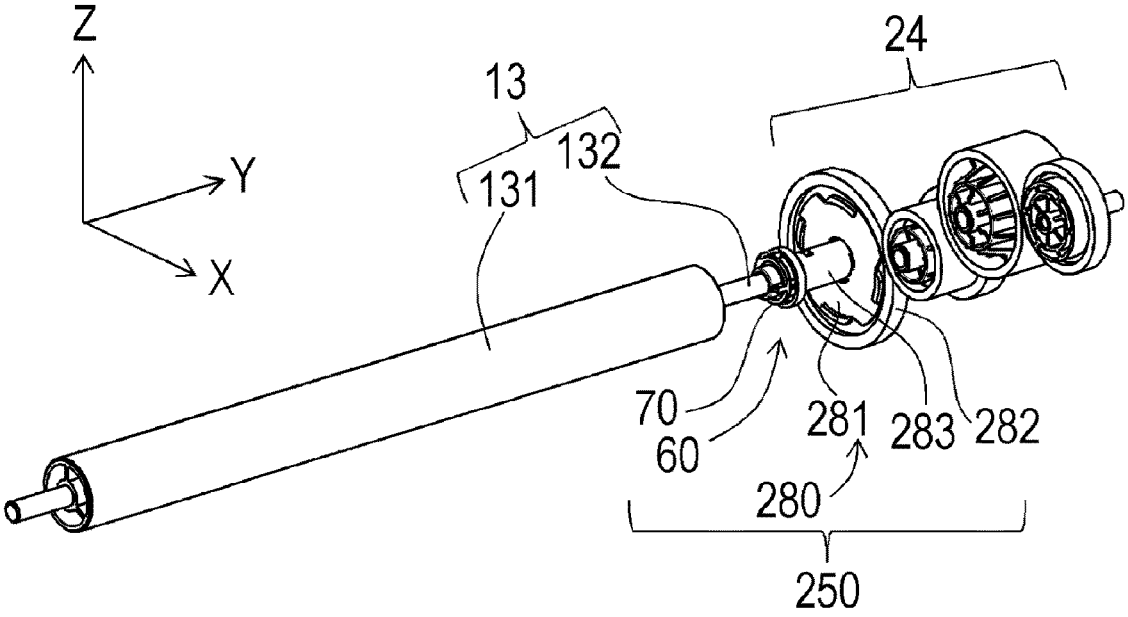
FIG. 12 is a perspective view depicting a configuration of a driving force transmitting unit of Embodiment 2.
Figure 13:
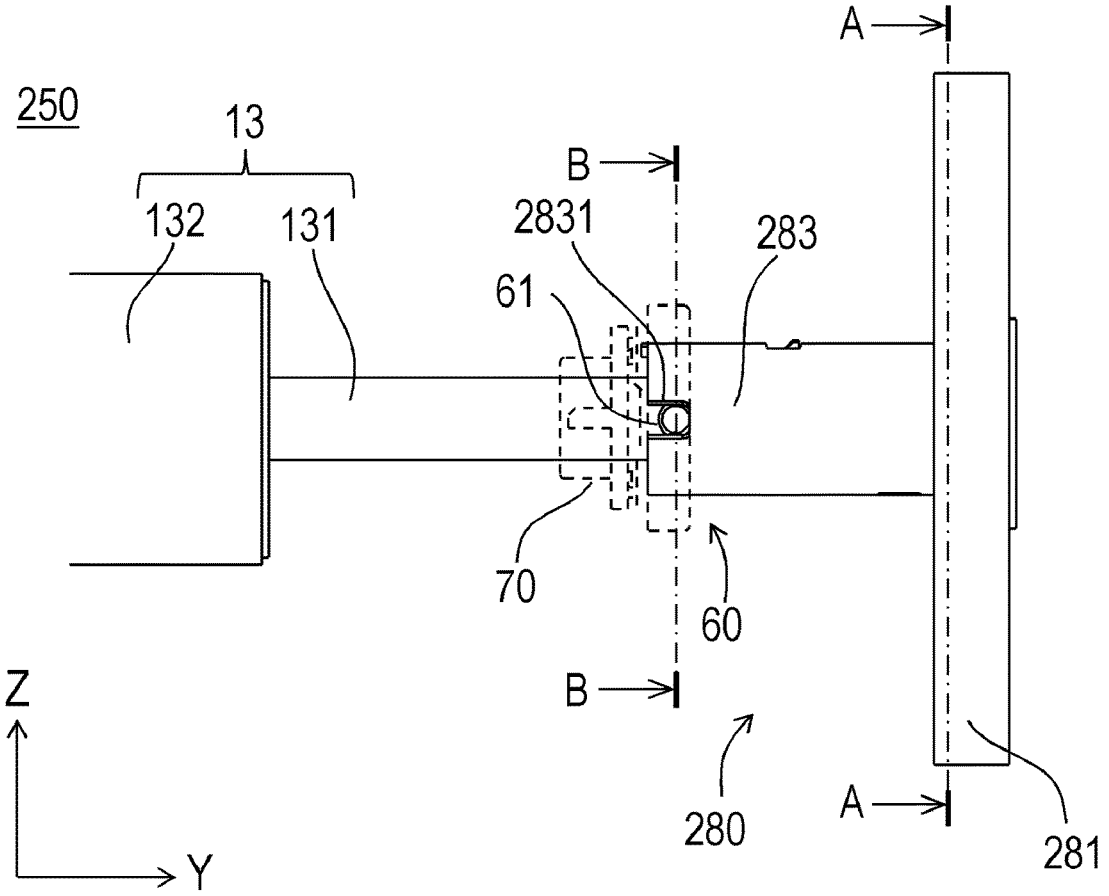
FIG. 13 is a diagram depicting the configuration of the driving force transmitting unit of Embodiment 2.
Figure 14:
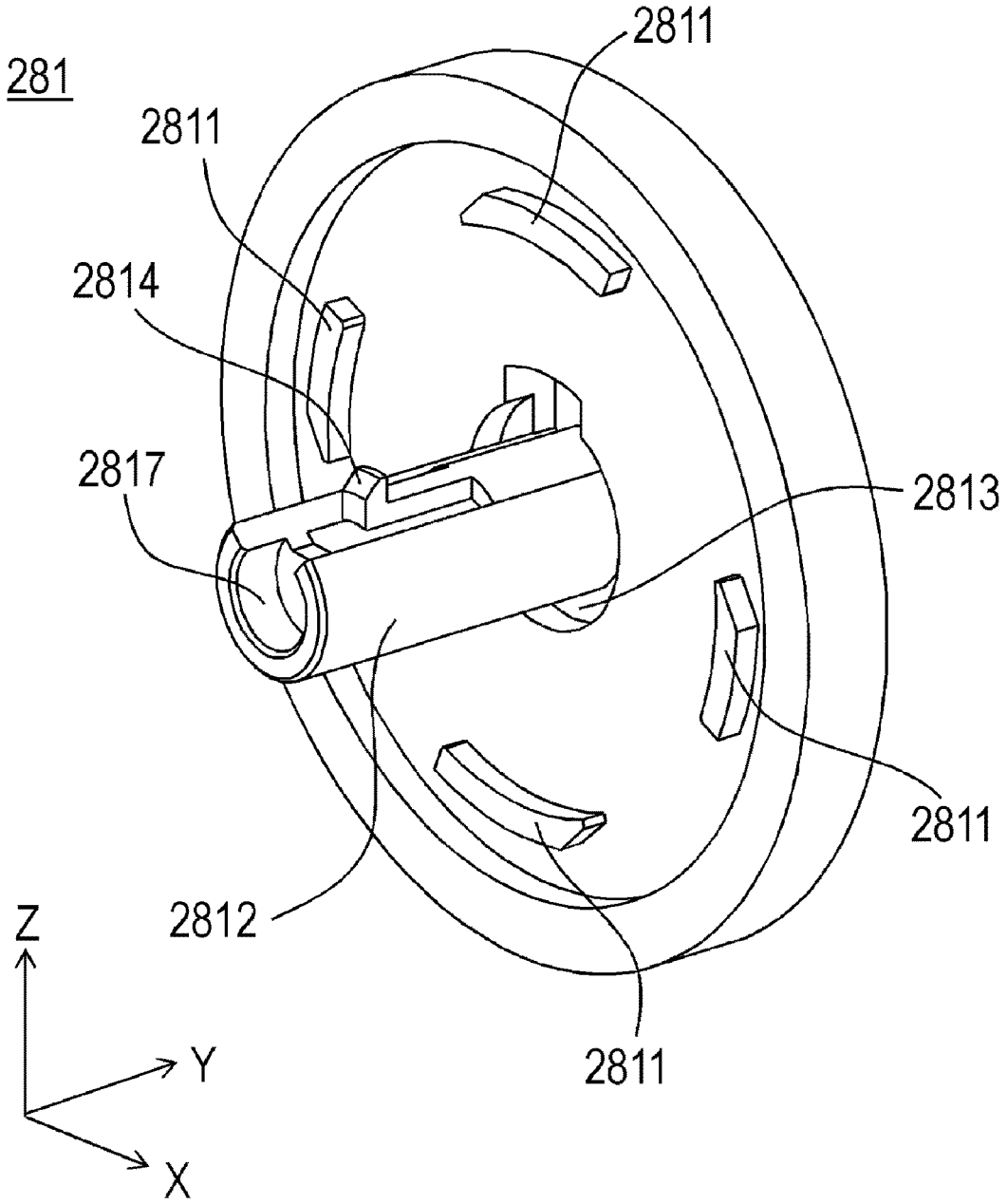
FIG. 14 is a perspective view depicting a shape of a driving force transmitting gear of Embodiment 2.

FIG. 12 is a perspective view depicting the belt driving force transmitting portion 250 according to Embodiment 2, and FIG. 13 is a diagram of the belt driving force transmitting portion 250 viewed from the front face of the main body. FIG. 14 is a perspective view of the driving force transmitting gear 281, and FIG. 15 is a cross-sectional view of the belt driving force transmitting portion 250 viewed in the same direction as FIG. 13.

In the same manner as in Embodiment 1, the driving force transmitting unit 280 of Embodiment 2 is also disposed on the driving source (not illustrated) side inside the belt driving force transmitting portion 250, and the driving force transmitting gear 281 receives the driving force (rotating force) from the driving force transmitting mechanism 24 and transmits the driving force to the cylindrical shaft 283 via the driving force transmitting plate 282.

Figure 15:
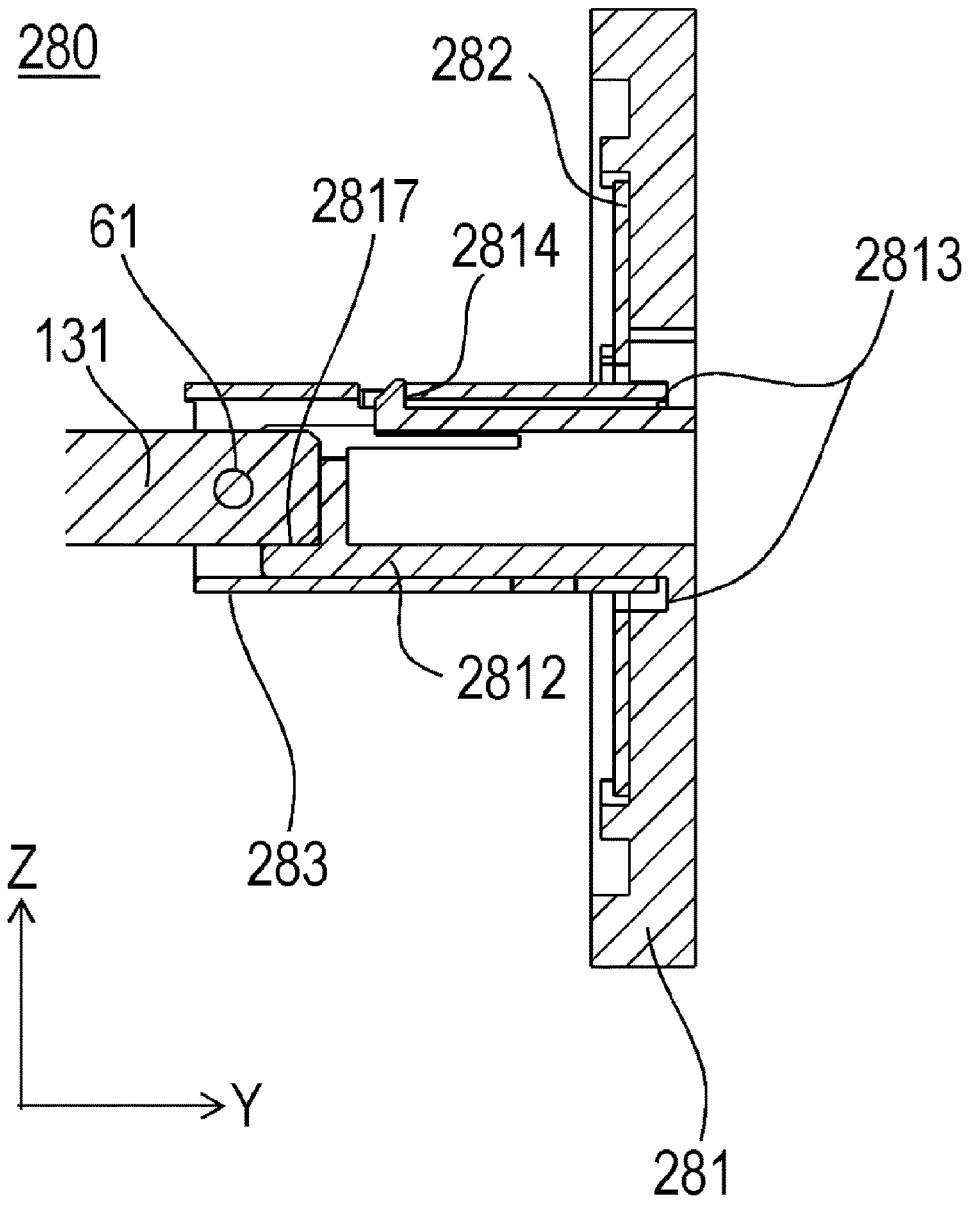
FIG. 15 is a cross-sectional view depicting the configuration of the driving force transmitting unit of Embodiment 2.

As illustrated in FIG. 14 and FIG. 15, a shaft-shaped central projected portion 2812 is disposed at the center of the driving force transmitting gear 281, and the cylindrical shaft 283 is inserted into the central projected portion 2812. A claw portion 2814 is disposed at the central projected portion 2812, and a groove 2813 is disposed at the root of the central projected portion 2812. Here the outer peripheral surface of the central projected portion 2812 and the inner peripheral surface of the cylindrical shaft 283 contact with each other, so as to align the center axis of the driving force transmitting gear 281 and the center axis of the cylindrical shaft 283. Thereby the rotation irregularities of the cylindrical shaft 283 are reduced, and a driving force transmission at high precision can be implemented.

Figure 16A:
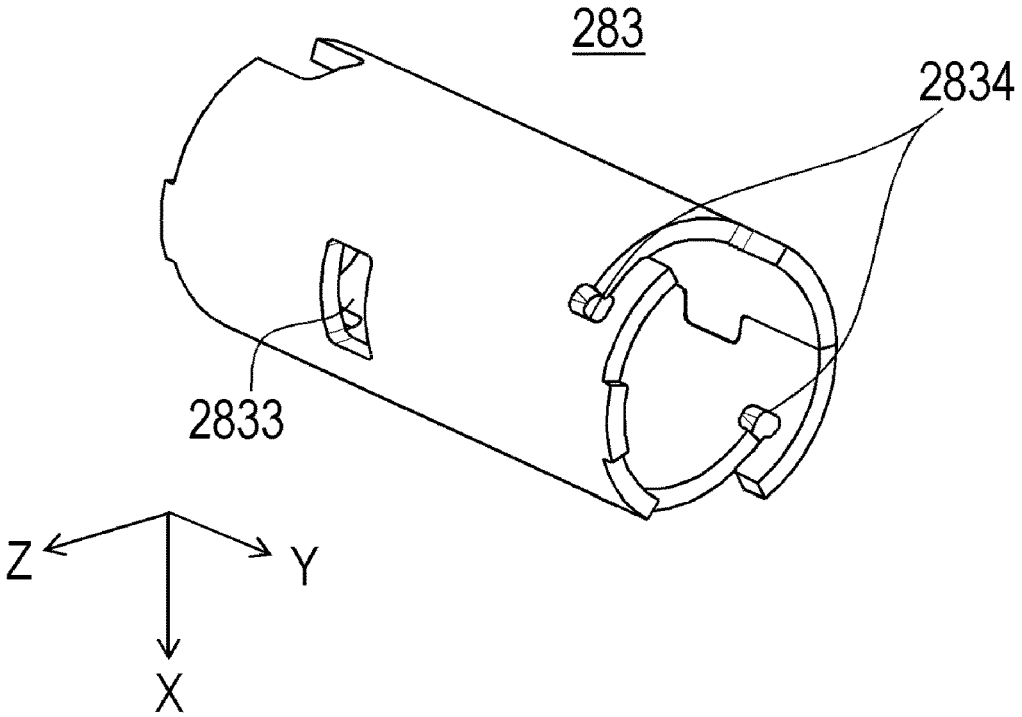
FIG. 16A and FIG. 16B are perspective views depicting a shape of a cylindrical shaft of Embodiment 2.
Figure 16B:
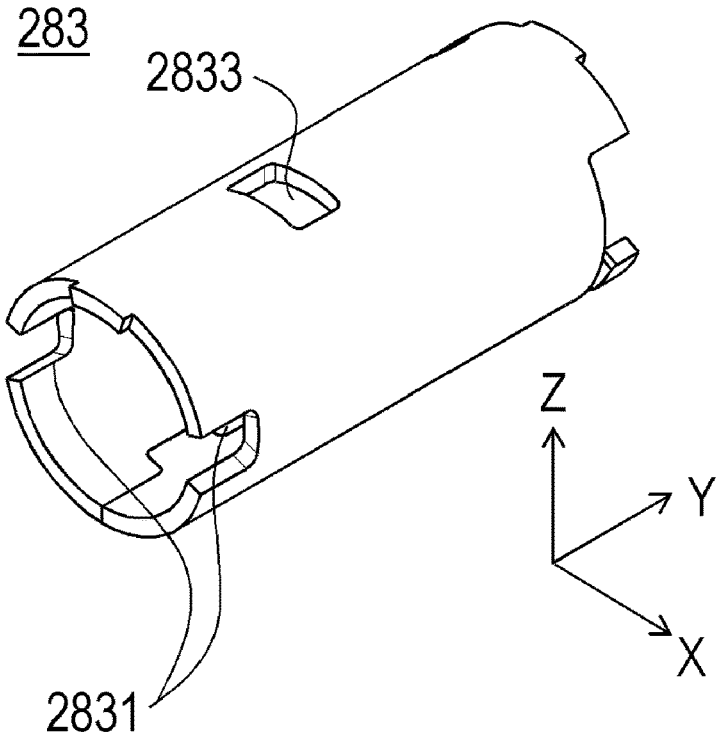

FIG. 16A and FIG. 16B are diagrams depicting the shape of the cylindrical shaft 283 according to Embodiment 2. The cylindrical shaft according to Embodiment 2 as well is a press-formed body formed by bending a metal plate into a cylindrical shape, just like Embodiment 1. As illustrated in FIG. 16A and FIG. 16B, a cut off shape 2834, a hole 2833 and a concave groove 2831 are disposed in the cylindrical shaft 283. The concave groove 2831 is a portion that engages with the pin 61 disposed in the driving force receiving portion 60. In Embodiment 2, just like Embodiment 1, a position where the through hole is formed and where the pin 61 and the cylindrical shaft 283 are engaged, in the axial direction of the shaft 131, is called a "driving force transmitting point" to transmit the driving force from the cylindrical shaft 283 to the shaft 131.

Figure 17:
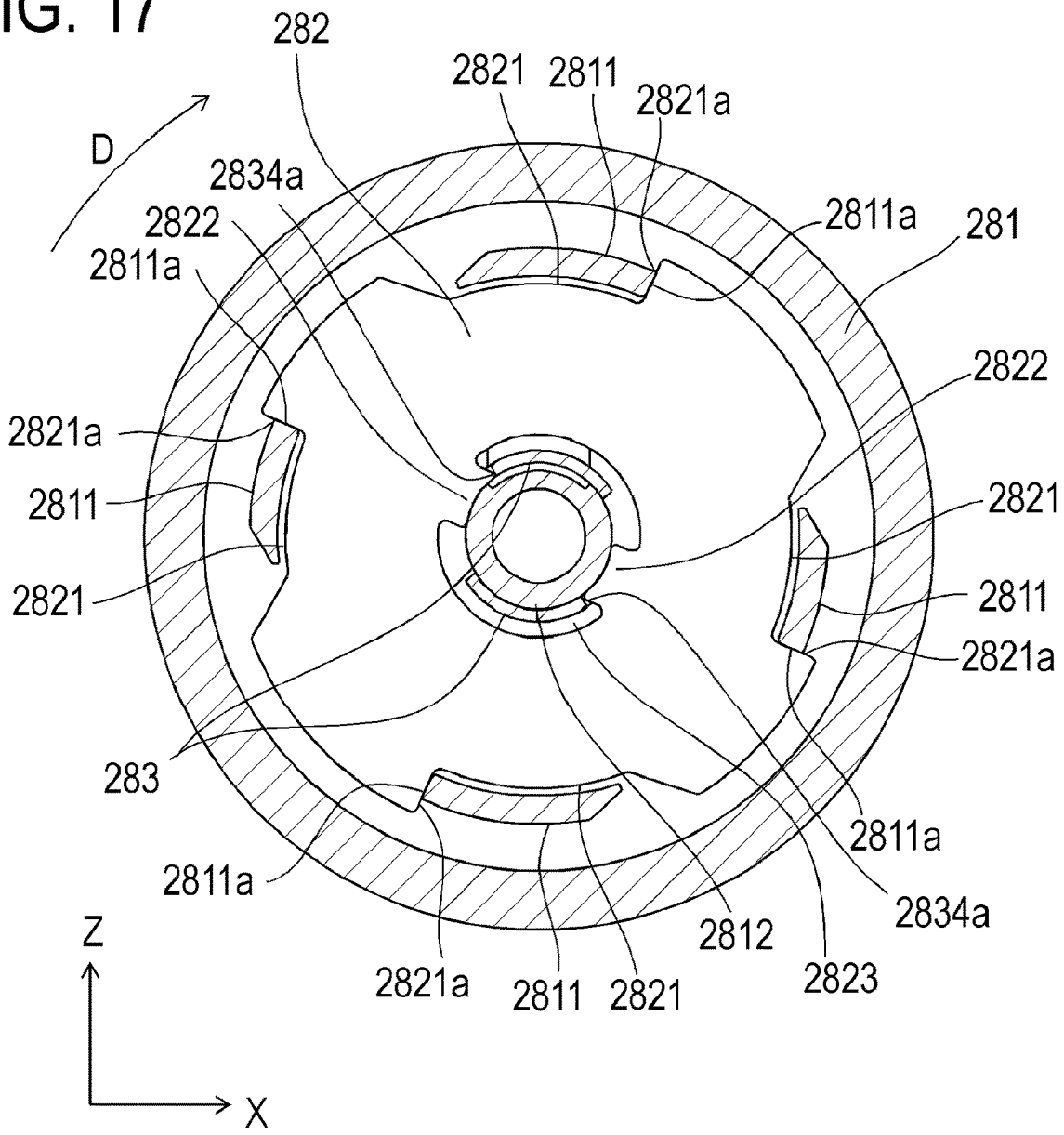
FIG. 17 is a cross-sectional view depicting the configuration of the driving force transmitting unit of Embodiment 2.

FIG. 17 is a cross-sectional view of the belt driving force transmitting portion 250, sectioned at a plane of the driving force transmitting plate 282 on the driving force receiving portion 60 side (cross-section at the A-A line indicated in FIG. 13). As illustrated in FIG. 17, on the side face of the driving force transmitting gear 281, one or a plurality of protruding portions 2811 are disposed on a same circumference that is distant from the center of a pitch circle of the gear by a predetermined distance. A driving force transmitting surface 2811*a* is disposed on each of the projected portions 2811 on the front side in the rotating direction D of the driving force transmitting gear 281. The driving force transmitting plate 282, on the other hand, is a plate member, and has one or a plurality of notches 2821 on the circular maximum outer peripheral surface. In each of the notches 2821, a driving force transmitted surface 2821*a* is disposed on the front side in the rotating direction inside the notch, so as to contact with the driving force transmitting surface 2811*a* of the projected portion 2811, disposed on the driving force transmitting gear 281, in the circumferential direction. The contacting surface of the driving force transmitting surface 2811*a* and the contacting surface of the driving force transmitted surface 2821*a* are located on a line connecting an arbitrary point on the circumference of the gear and the center. Thereby the direction of the force applied to the contacting surface can be aligned with the rotation direction, and the driving force transmitting loss can be controlled.

The driving force transmission from the driving force transmitting gear 281 to the driving force transmitting plate 282 is performed between the driving force transmitting surface 2811*a* of the driving force transmitting gear 281 and the driving force transmitted surface 2821*a* of the driving force transmitting plate 282, which contact each other in the circumferential direction. The contacting portion between the driving force transmitting surface 2811*a* and the driving force transmitted surface 2821*a* is disposed to be distant from the center of the driving force transmitting gear 281 by a predetermined distance, hence the force applied to the contacting surface in accordance with the distance from the center of the gear, with respect to the torque of the shaft, can be decreased. Further, if a plurality of driving force transmitting surfaces 2811*a* and driving force transmitted surfaces 2821*a* are disposed, the load applied to one location of the driving force transmitting surface 2811*a* on the gear can be distributed in accordance with the number of disposed driving force transmitting surfaces 2811*a* and driving force transmitted surfaces 2821*a*.

Figure 18:
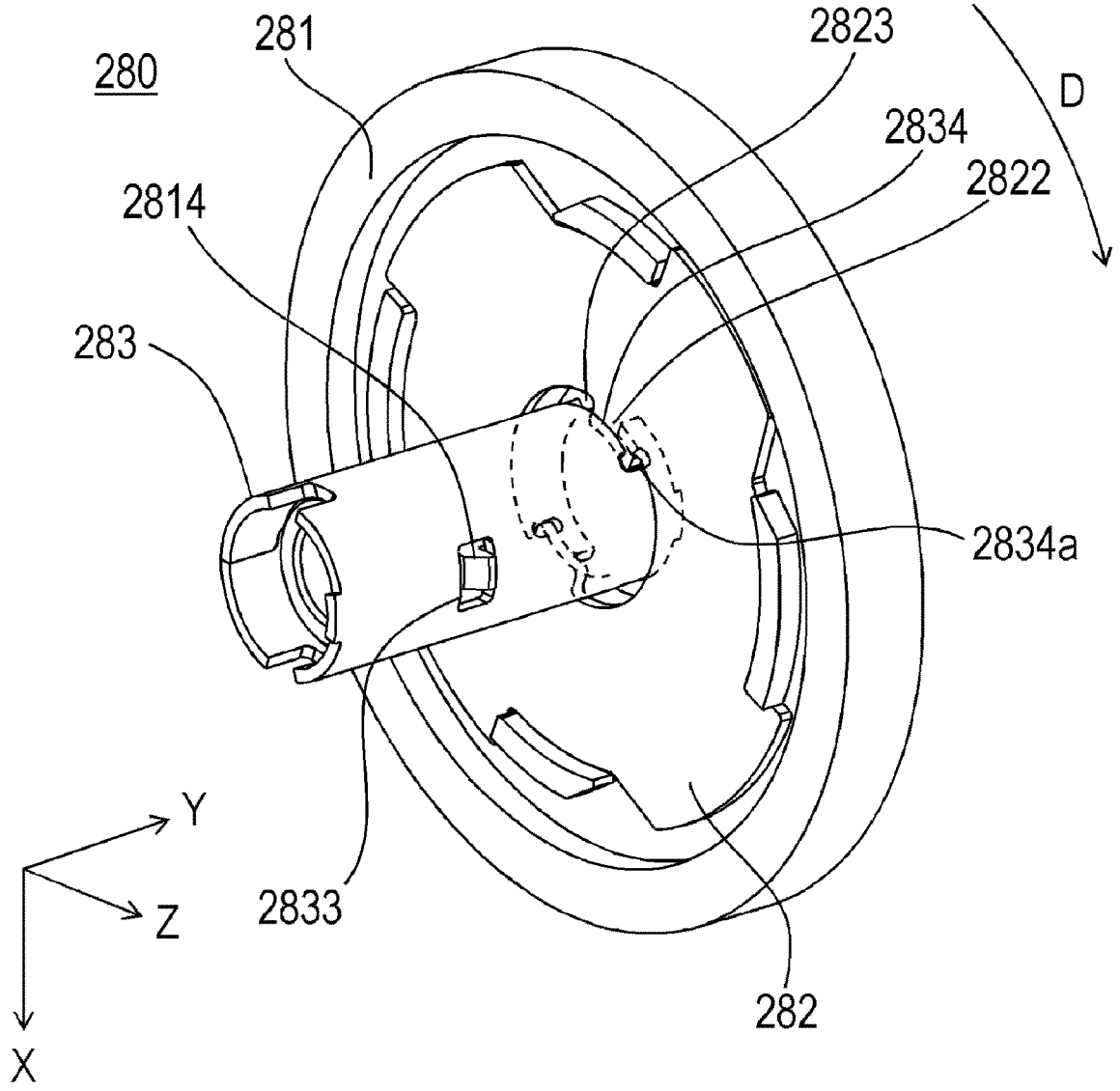
FIG. 18 is a perspective view depicting the configuration of the driving force transmitting unit of Embodiment 2.

An approximately circular hole 2823 is formed at the center portion of the driving force transmitting plate 282, and one or a plurality of protruding portions 2822 are disposed so as to protrude from the inner peripheral surface of the hole 2823 in the direction toward the center (inward in the diameter direction). Each of the protruding portions 2822 is configured to fit into each cut off shape 2834, which is formed in the cylindrical shaft 283 and extends toward the circumferential direction. FIG. 18 indicates a state where the protruding portion 2822 fits into the cut off shape 2834. By the protruding portion 2822 fitting into the cut off shape 2834 like this, the position of the driving force transmitting plate 282 in the axis direction, with respect to the cylindrical shaft 283, is regulated. An abutting portion 2834*a* of the cut off shape 2834 becomes a contacting portion with the protruding portion 2822, that is, becomes a driving force receiving portion.

Here the protruding portion 2822 transmits the driving force by contacting with an end face 2834*a*, which is the end of the cut off shape 2834 of the cylindrical shaft 283, hence the tip of the protruding portion 2822 enters the inner side of the radius of the outer peripheral surface of the cylindrical shaft 283. The diameter of the portion of the hole 2823, excluding each protruding portion 2822, is larger than the diameter of the outer peripheral surface of the cylindrical shaft 283. The claw portion 2814 of the driving force transmitting gear 281 fits into the hole 2833, which is formed to penetrate the cylindrical shaft 283 in the diameter direction perpendicular to the axial line, so as to regulate the position of the cylindrical shaft 283 in the thrust direction and the circumferential direction with respect to the driving force transmitting gear 281.

When the claw portion 2814 of the driving force transmitting gear 281 is fit into the hole 2833 in the state of the protruding portion 2822 fitting into the cut off shape 2834 like this, the position of the driving force transmitting plate 282 in the axial line direction with respect to the cylindrical shaft 283 is regulated, and the position of the driving force transmitting plate 282 in the circumferential direction is regulated by the protruding portion 2811 of the driving force transmitting gear 281 and the end face 2834*a* inside the cut off shape 2834. On the other hand, the position of the cylindrical shaft 283, with respect to the driving force transmitting gear 281 in the axial line direction and the circumferential direction, is also regulated, and the driving force transmitting gear 281, the cylindrical shaft 283 and the driving force transmitting plate 282 become one unit (driving force transmitting unit 280). At this time, the driving force transmitting gear 281, the driving force transmitting plate 282 and the cylindrical shaft 283 are installed with end play from each other in the rotating direction, so that the driving force transmission can be performed at correct contacting portions from the driving force transmitting gear 281 to the driving force transmitting plate 282, and from the driving force transmitting plate 282 to the cylindrical shaft 283. At least a part of the driving force transmitting unit 280 is energized toward the driving force receiving portion 60 by an energizing member (not illustrated), so that the cylindrical shaft 283 is engaged with the driving force receiving portion 60.

In the vicinity of the tip of the protruding portion 2811 of the driving force transmitting gear 281 and the contacting portion between the cylindrical shaft 283 and the pin 61, a contacting portion 2817, that contacts with the outer periphery of the shaft 131, is disposed. FIG. 14 indicates the shape of the contacting portion 2817, and FIG. 15 indicates a state where the tip of the shaft 131 contacts with the contacting portion 2817. In Embodiment 2, the contacting portion 2817 is disposed in the vicinity of the contacting portion between the cylindrical shaft 283 and the pin 61 in the direction of the center axis of the driving force transmitting gear 281, thereby deviation of the driving force transmitting point is controlled, and stable driving force transmission is implemented.

According to Embodiment 2, in the belt driving force transmitting portion 250, the contacting portion 2817, disposed in the driving force transmitting gear 281, contacts with the outer peripheral surface of the shaft 131 to which driving force is transmitted via the cylindrical shaft 283, as mentioned above, whereby the rotary driving force is transmitted from the driving force transmitting gear 281 to the driving roller 13. Because of this configuration, deviation of the driving force transmitting point between the cylindrical shaft 283 and the shaft 131 is controlled, and a driving force transmission at even higher precision is implemented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-142023, filed on Aug. 25, 2020, which is hereby incorporated by reference herein in its entirety.

What is claimed is:

1. A driving force transmitting mechanism comprising:

a first rotating member which includes a transmitting surface and rotates around a first rotation axis;

a driving force transmitting member which includes a transmitted surface and rotates together with the first rotating member, and to which a driving force is transmitted from the first rotating member by the transmitted surface contacting with the transmitting surface;

a cylindrical shaft which contacts with the first rotating member in a direction perpendicular to the first rotation axis, and which includes an engaging portion to engage with the driving force transmitting member, and is coaxially rotated with the first rotating member by a driving force transmitted from the driving force transmitting member at the engaging portion; and a second rotating member which is rotated around a second rotation axis, disposed next to the first rotation axis in an axial direction, by a driving force transmitted from the cylindrical shaft, wherein the first rotating member further includes at least one contacting portion that contacts with an outer peripheral surface of the second rotating member.

2. The driving force transmitting mechanism according to claim 1, wherein a contacting surface between the first rotating member and the cylindrical shaft in a direction perpendicular to the first rotation axis is disposed inward from the transmitting surface and the transmitted surface with respect to a radius direction.

3. The driving force transmitting mechanism according to claim 1, wherein a position at which the at least one contacting portion contacts with the outer peripheral surface of the second rotating member overlaps with a driving force transmitting point from the cylindrical shaft to the second rotating member at least partially in the axial direction.

4. The driving force transmitting mechanism according to claim 1, further comprising a connecting member which is inserted into a through hole formed in the second rotating member, and which is capable of engaging with the cylindrical shaft in a state of being inserted into the through hole, wherein a position at which the at least one contacting portion contacts with the outer peripheral surface of the second rotating member overlaps with a position at which the cylindrical shaft and the connecting member are engaged at least partially in the axial direction.

5. The driving force transmitting mechanism according to claim 1, wherein the cylindrical shaft is formed by abutting both end portions of a metal plate.

6. The driving force transmitting mechanism according to claim 5, wherein a contacting surface between the first rotating member and the cylindrical shaft in the direction perpendicular to the first rotation axis is disposed at a position not in contact with a joint portion where the both end portions of the metal plate are abutted.

7. The driving force transmitting mechanism according to claim 1, wherein the first rotating member further includes a claw portion that engages with the driving force transmitting member, wherein the first rotating member, the driving force transmitting member, and the cylindrical shaft are integrated by the claw portion engaging with the driving force transmitting member.

8. The driving force transmitting mechanism according to claim 1, wherein the cylindrical shaft further includes a cut off shape which extends toward a circumferential direction, and a hole that penetrates in a direction perpendicular to an axial line of the cylindrical shaft, wherein the driving force transmitting member further includes a protruding portion that fits into the cut off shape, wherein the first rotating member further includes a claw portion which fits into the hole, wherein the first rotating member, the driving force transmitting member, and the cylindrical shaft are integrated by the protruding portion fitting into the cut off shape and the claw portion fitting into the hole.

9. The driving force transmitting mechanism according to claim 1, wherein the driving force transmitting member is formed by a metal plate.

10. The driving force transmitting mechanism according to claim 1, wherein the first rotating member includes a plurality of the transmitting surfaces and the driving transmitting member includes a plurality of the transmitted surfaces.

11. The driving force transmitting mechanism according to claim 1, wherein the driving force transmitting member further includes a hole in which the first rotating member is inserted and a protruding portion which protrudes from an inner peripheral surface of the hole toward a center of the driving force transmitting member, and the protruding portion contacts with the engaging portion.

12. An image forming apparatus comprising:

a rotating member; and the driving force transmitting mechanism, according to claim 1, that transmits a rotary driving force to the rotating member.

* * * * *